US005948185A

United States Patent [19]

Krajewski et al.

[11] Patent Number: 5,948,185

[45] Date of Patent: Sep. 7, 1999

[54] METHOD FOR IMPROVING THE HEMMABILITY OF AGE-HARDENABLE ALUMINUM SHEET

[75] Inventors: Paul Edward Krajewski, Sterling Heights; Edward Frank Ryntz, Warren, both of Mich.

[73] Assignee: General Motors Corporation, Detroit, Mich.

[21] Appl. No.: 08/846,453

[22] Filed: May 1, 1997

[51] Int. Cl.[6] ..... C22C 21/00

[52] U.S. Cl. ..... 148/698; 148/691; 148/694; 148/688; 148/695; 148/417; 148/415; 148/416

[58] Field of Search ..... 148/691, 694, 148/698, 688, 695, 417, 415, 416; 420/532, 534

[56] References Cited

U.S. PATENT DOCUMENTS

| | | | |
|---|---|---|---|
| 3,856,584 | 12/1974 | Cina | 148/159 |
| 3,945,861 | 3/1976 | Anderson et al. | 148/12.7 |
| 4,405,386 | 9/1983 | Mravic et al. | 148/11.5 A |
| 4,766,664 | 8/1988 | Benedyk | 29/512 |
| 5,525,169 | 6/1996 | Murtha | 148/695 |

FOREIGN PATENT DOCUMENTS

| | | |
|---|---|---|
| 0 699 775 A1 | 3/1996 | European Pat. Off. . |
| WO 97/44147 | 11/1997 | WIPO . |
| WO 98/08996 | 3/1998 | WIPO . |

OTHER PUBLICATIONS

Element of materials science Van Vlack. pp. 275–313, ©1964.

ASM Metals Handbook 9th ed. vol. 2 pp. 24–32 & 50–51.

*Primary Examiner*—Patrick Ryan
*Assistant Examiner*—M. Alexandra Elve
*Attorney, Agent, or Firm*—George A. Grove

[57] ABSTRACT

An improved method of forming a severe bend or a hem in a sheet of wrought aluminum age-hardened and age-hardenable alloy includes heating the region to be bent or hemmed to a temperature above about 250° C. for a period of seconds and then quenching the heated region to remove the age-hardening effect and thereafter accomplishing the bend or hem before age hardening of the heated region occurs.

3 Claims, 3 Drawing Sheets

METHOD FOR IMPROVING THE HEMMABILITY OF AGE-HARDENABLE ALUMINUM SHEET

TECHNICAL FIELD

This invention pertains to the forming of age-hardened aluminum sheet material, and more specifically it relates to improvements in forming hems and hemmed bonds in such an aluminum sheet member.

BACKGROUND OF THE INVENTION

The use of aluminum alloys in the manufacture of automobile bodies and components has increased in part due to the need to reduce the weight of the vehicles for improved fuel economy. One application for aluminum alloys in the manufacture of automobiles is in the forming of body panels from aluminum alloy sheet stock. For example, hoods, doors and deck lids are formed by stamping an inner panel and an outer panel from suitable aluminum sheet stock. The outer panel forms the decorative and functional outline of the vehicle panel. The inner panel serves a reinforcing function. In the manufacture, then, of such a two-layer construction, the outer sheet is provided with suitable flanges at its edges. The inner sheet is laid against the outer sheet within the flanges, and the flanges are bent against the inner sheet in a hemming operation.

A series of aluminum sheet alloys have been developed which are strong and hard due to the presence of precipitated, finely divided hardening particles. One such series is the AA2XXX series in which small amounts of copper and magnesium, for example, are added to the aluminum alloy to contribute to hardening particle formation. Another series is the AA6XXX series where silicon, magnesium and copper are added for hardening. A third series is the AA7XXX series where zinc, magnesium and copper, for example, are added as hardening constituents. These alloys are well known and commercially available. They are formed into sheet stock from cast billets by a suitable sequence of hot rolling and cold rolling operations. Usually at the finish of the sheet forming/rolling operation, the sheet material is heated to dissolve in solid solution the small amounts of prospective hardening particles or transition phases such as $Mg_2Si$ or GP zones (e.g., in the 6XXX series) and the like. The sheet is then quenched to retain such secondary phases in an unstable solution. The quenched material may be allowed to age at room temperature, whereupon the dissolved hardening constituents slowly reprecipitate in a very finely divided state to strengthen and harden the sheet. Such room temperature-aged alloys are usually identified as having a T4 temper designation. In some cases, the alloy is reheated after the quenching operation to induce reprecipitation of the hardening phases. The alloy is then designated as being in a T6 temper condition. The T6 alloys are usually stronger and harder than the T4 alloys. The terms "age hardening" and "precipitation hardening" are used interchangeably herein to include aluminum alloys aged at room temperature and alloys heated above room temperature to accelerate or increase the strengthening and hardening effect.

Thus, when an automobile body panel is formed from an aluminum alloy such as AA6111-T4, it is in an age-hardened condition. The properties of the alloy are a compromise which enable it to undergo suitable stamping and drawing operations and the like for shaping into a body panel and yet provide suitable strength and hardness in the finished panel.

A difficulty is that such age-hardened alloys, for example, the AA 2XXX, 6XXX and 7XXX series, are not sufficiently ductile to undergo all desired forming operations such as the above-described hemming operation that are desirable in the formation of a class A finish automotive exterior body panel. It is found that in the severe forming of such sheet alloys as, for example, where a sheet edge is bent flat against itself in a straight line hemming operation, cracks form in the outer bent surface of the hemmed sheet which detract from its appearance, its strength and its corrosion resistance.

Accordingly, it is highly desirable to have a method by which such hemming operations and other like severe bending or folding operations can be conducted on a precipitation-hardened aluminum alloy sheet without forming cracks or other defects in the bent or folded body.

SUMMARY OF THE INVENTION

In accordance with the invention, a method is provided for selectively heat treating the region to be hemmed of a previously precipitation-hardened aluminum alloy sheet. The heat treatment is performed just prior to such hem forming operation or before any other severe bending operation on the sheet.

By way of illustration, a sheet of, for example, AA6111-T4 material may be formed in a draw die at substantially ambient temperature into the configuration of a desired automotive body panel. Subsequent trimming and piercing operations, if required, are carried out. Then, preparatory to a hemming operation, flanges are formed, more or less at right angles, from edges of the formed sheet. In accordance with a practice of the subject method, the bent flanged portion of the stamped body panel is heat treated as, for example, by rapid induction heating to a temperature in the range of 250° C. to 500° C. for a period of up to about, for example, ten seconds and immediately quenched by cooling with sprayed air or water.

Thereafter within a period of about three hours, the heat-treated flanged sheet may then be coated with a suitable adhesive in the regions within the flanges at which the inner panel is to be attached. An inner panel is laid against the adhesive coated surfaces of the flanged sheet, and the flange is then bent fully around to tightly engage the surface of the inner panel member and press it against the adhesive coated outer panel. The hem may be a flat hem or a rope hem.

The heat treated softer region of the hem area will regain its physical properties by work hardening and subsequent aging.

These and other objects and advantages of the invention will become more apparent from a detailed description thereof which follows. Reference will be had to the drawing figures in which:

DESCRIPTION OF THE PREFERRED EMBODIMENT

Figure 1:
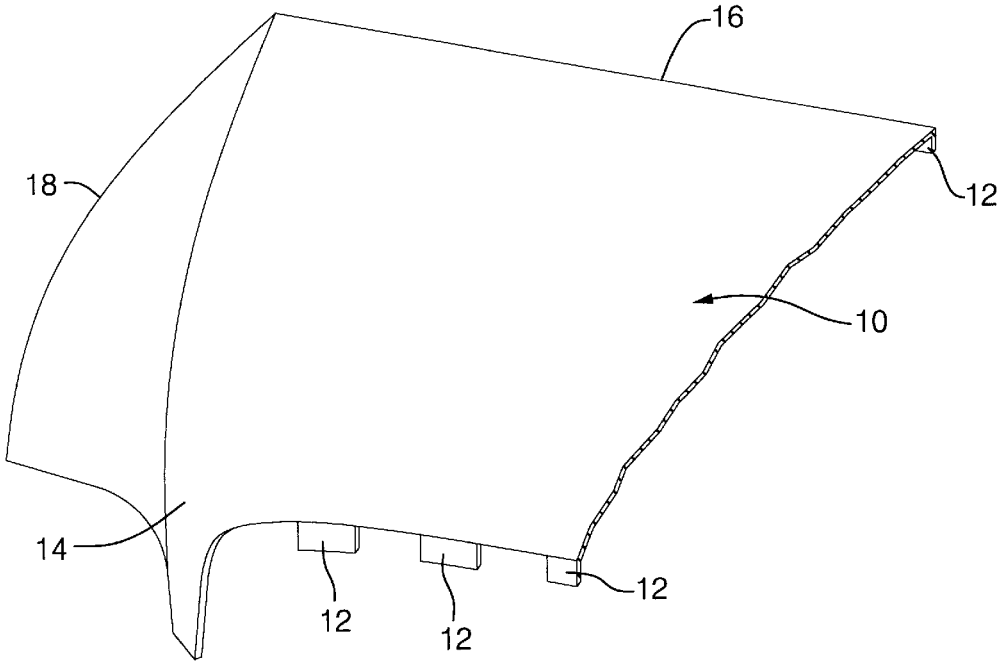
FIG. 1 is a perspective view of half of a stamped sheet for an outer automotive hood panel.

This invention is applicable to improving hemming operations on sheets of aluminum alloys that are age hardenable. Such aluminum alloys are formulated to contain, for example, suitable quantities of aluminum and copper to form an aluminum-copper intermetallic compound, or suitable quantities of magnesium and silicon to form magnesium-silicon intermetallic compounds, or suitable quantities of copper, magnesium and zinc to form an intermetallic compound of these constituents. When the alloy is heated to a suitable elevated temperature, the intermetallic compounds dissolve in solid solution, but upon suitable cooling the precipitates can reform. If such an alloy is quenched from its solution heat treatment temperature, the precipitates form over a period of hours and days by a process called "age hardening" to increase the physical properties of the alloy. In some instances, the alloys are reheated following their quenching operation to accelerate the reprecipitation process. In the cases of the precipitation-hardened alloys used in the practice of this invention, a T4 temper designation means that the alloy was age hardened essentially at room temperature, and a T6 temper designation means that the alloy was age hardened at elevated temperature.

The invention will now be illustrated with application to an AA6111-T4 alloy. The nominal composition of the AA6111 alloy is, by weight, 0.5 to 1.0 percent magnesium, 0.5 to 0.9 percent copper, 0.7 to 1.1 percent silicon, 0.4 percent iron max, and the balance substantially aluminum. In the case of this alloy, the hardening constituent is usually considered to be a $Mg_2Si$ intermetallic compound or related transition phase.

Blanks from cold rolled coils of the AA6111-T4 alloy would be used in a stamping plant, for example, for making hoods in automobile manufacture. A series of mechanical or hydraulic actuated presses using matched dies would be used to perform the various forming operations on a suitable initially-flat blank of the alloy sheet. An automobile or truck hood would typically include a stamped outer panel and a complementary stamped inner panel of slightly smaller dimensions and adapted to fit inside the outer panel within flanges bent at the edges of the outer panel by forming dies. A suitable adhesive is often applied to the surface of the outer panel or the inner panel, and they are placed together and then the flanges on the outer panel are folded back on the inner panel to complete the bond between the two panels. The thickness of such a hemmed bond is equivalent to slightly more than twice the thickness of the outer panel plus the thickness of the inner panel. In general, the thickness of each panel is of the order of one millimeter.

A preformed blank of the AA6111-T4 sheet for forming in a suitable male/female stamping die configuration is appropriately shaped into the hood outer panel in a first forming step. The product of this step is a shaped sheet in the configuration of the hood with unformed material at the edges. The formed sheet is then transferred to a second press where the extraneous material is trimmed away and any necessary piercing operations on the formed sheet for part assembly carried out. The formed, trimmed and pierced hood outer panel is then transferred to another press in which hem flanges are formed at edge surfaces of the body panel.

Referring to FIG. 1 of the drawings, there is illustrated in perspective view one-half of a hood outer panel 10 for an automobile. As described, the panel has been formed and trimmed and provided with the flanges 12. The flanges 12 at the front 14 and back 16 of the hood 10 are shown. The flanges along the side 18 of the outer panel extend coextensively with those portions of the panel but are hidden in this view.

An inner panel is formed separately with different die sets. It is shaped in a first die set and then trimmed as necessary. Both inner and outer hood panels are likely to be stored for a period of time in the hood manufacturing plant before they are joined. At such time as it is desired to bring the panels together, a stamped and flanged outer panel 10 is placed in a suitable fixture for suitable physical support and heat treatment in accordance with this invention.

Figure 2:
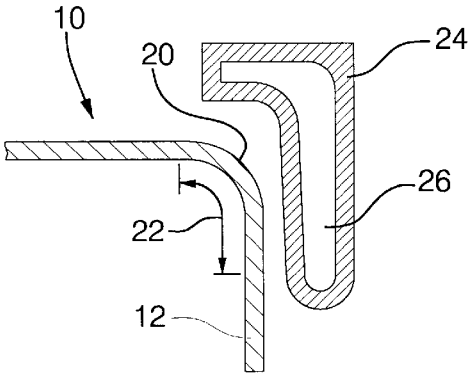
FIG. 2 is a cross-section of a flange region of the sheet depicted in FIG. 1.

FIG. 2 shows in cross-section an edge portion of a hood panel 10 with its flange 12. It is seen that the flange is bent to extend substantially at 90 to 105 degrees with respect to the main portion of the hood. The length of the flange at the front of the hood is about 25 mm. This outer hood panel with flange 12 directed downwardly is then brought into close proximity with a suitable heating apparatus such as an induction heating fixture. Other heating modes could be employed such as immersion in a hot oil bath or hot salt bath, laser heating, contact with heated platens or the like. However, in general, it is a cleaner and more efficient operation to use a suitable induction heating coil fixture arranged to heat around the whole flanged periphery of the panel 10. Heating is limited to just the bend portion 20 of the hood and flange, and part way down the portion of the flange which is expected to undergo further deformation in the hemming operation. The heated region of the hood sheet with flange 12 is indicated as area 22 in the cross-sectional view of FIG. 2. The hood panel is supported by a fixture (not shown) closely adjacent the region to be heated 22 so that the localized heating and/or cooling does not warp or distort the hood panel.

Induction heating coil 24, shown in section in FIG. 2, is shaped to selectively heat region 22 of the flange 12 and bend 20. Coil 24 has an internal passage 26 for water cooling and is shaped to be closely adjacent the bend and flange.

The coil 24 is activated to heat all of the flange regions around the periphery of the hood panel simultaneously to temperatures in the range of 250° C. to 500° C. to locally redissolve the hardening constituents of the 6111 alloy. Such heating normally will not exceed a period of seconds, e.g., ten seconds. The heated regions are then immediately quenched by water spray or high pressure air spray (or even self-quenched by the surrounding mass) to temporarily retain the softened characteristic of the heat treated region. In general, such a softening treatment is termed a retrogression treatment because it undoes previous precipitation hardening practices.

As stated, this localized softening for hemming is short-lived, and the hem formation should usually be completed within about 200 minutes of the softening operation.

Figure 3:
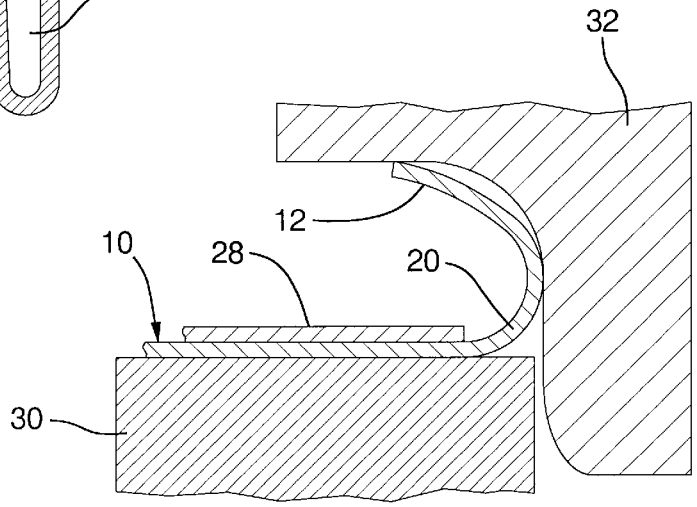
FIG. 3 is a cross-section of the edge of an inner panel laid against the flanged end of the outer panel and showing the hemming operation under way.

In FIG. 3 is shown the same cross section of the edge portion of the outer panel 10 and its softened flange member 12 with the edge portion 28 of the inner panel lying against the inside surface of outer panel 10. A matched flange bending die pair 30, 32 is then brought into contact with the flange 12 of the outer panel 10 folding the flange against inner panel 28 to form the hem.

Figure 4:
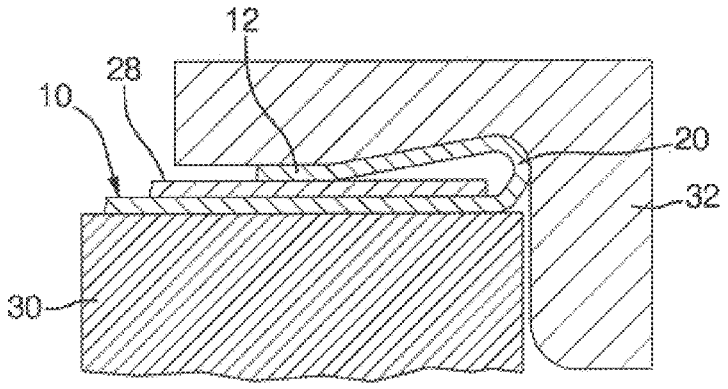
FIG. 4 shows the final hem formation of the operation shown in FIG. 3, in this case, a rope hem joint.

FIG. 4 shows the same cross section as FIG. 3 with hem formation completed. Flange 12 is pressed against inner panel 28, which is in turn pressed against outer panel 10.

Figure 5:
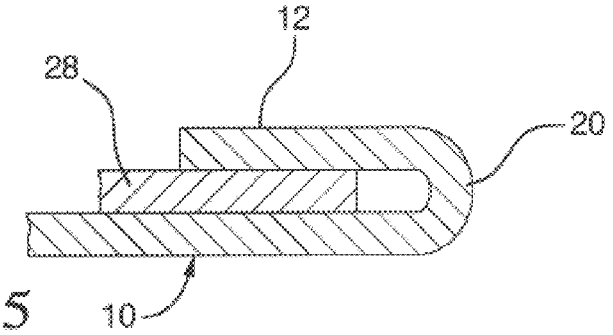
FIG. 5 illustrates a flat hem structure for the hemmed panel assembly of FIG. 4.

In the case of this illustrated operation, the resulting hem is not fully flat because the bend at 20 is not fully folded; it is a hem structure known as a rope hem (as though the fold had been made around a rope). Forming a rope hem is a milder hemming operation than forming a fully flat hem as is depicted in FIG. 5. A flat hem is desired because it is a neater finishing structure providing better appearance and better fit with adjoining body structure members. The process of this invention permits either flat hems or rope hems to be formed in precipitation-hardened alloys.

Figure 6:
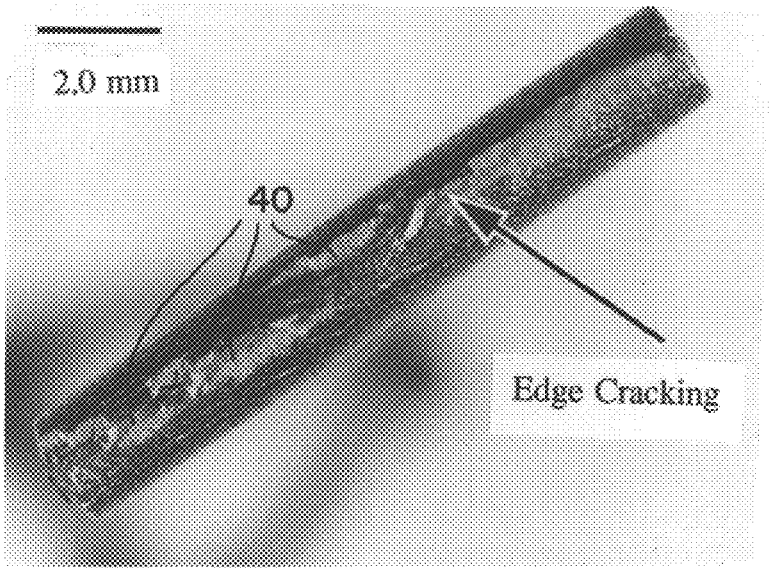
PRIOR ART FIG. 6
FIG. 6 is a photograph of a flat hem edge in a 6111-T4 sheet formed without the heat treatment of this invention.
Figure 7A:
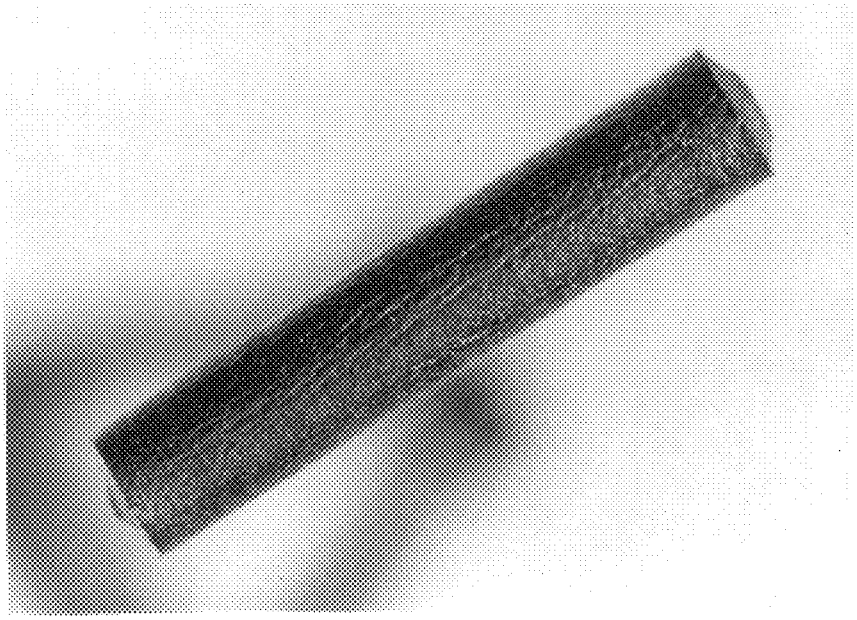
FIG. 7A is a photograph of a flat hem edge in a 6111-T4 sheet formed after heating at 300° C. for five seconds.
Figure 7B:
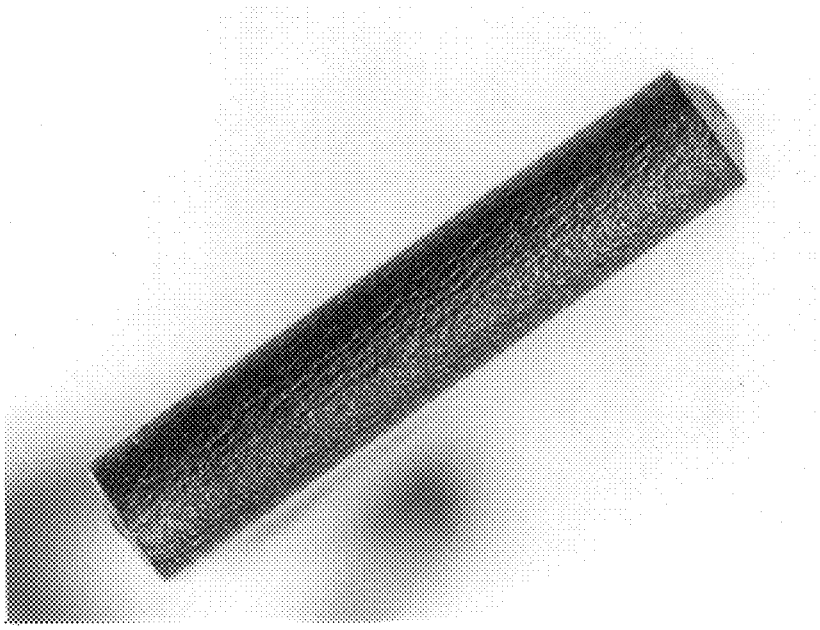
FIG. 7B is a photograph of a flat hem edge in a 6111-T4 sheet formed after heating at 475° C. for seven seconds.

The photographs of FIGS. 6, 7A and 7B further illustrate advantages of this invention. FIG. 6 shows the extensive edge cracking 40 in a 1 mm thick strip of age-hardened AA6111-T4 alloy that has been folded on itself in a vise. This sample has not been subjected to the heat treatment of this invention. FIG. 7A shows a like folded piece of the AA6111-T4 alloy which was heat treated for five seconds at 300° C. before bending. The piece was fully bent upon itself (so-called 0° bend) with no edge cracking at all. A similar result was obtained (FIG. 7B) on another 1 mm strip of the AA6111-T4 alloy when it was heated for seven seconds at 475° C. The bent strips in the photographs are somewhat enlarged to better show the presence or absence of edge cracking.

In the above example, a flange was formed in the age-hardened sheet before the subject heat treatment was applied and the hem formed. It is also possible to form the hem in a single folding operation after the softening heat treatment.

The specific heat treatment time and temperature will, of course, need to be developed for each alloy that is to be so severely bent, folded or hemmed. However, in general, the above-identified precipitation-hardenable aluminum alloys are susceptible to substantial improvement in their hemming and other bending or folding operations by heat treatment of the region of the sheet to be bent or hemmed at a temperature in the range of about 250° C. to 500° C. for a period of a fraction of a second to about ten seconds followed by a quench operation. Such heating and quenching temporarily softens the treated region of aluminum sheet to facilitate the bending operation. In the case of the AA6111 alloy, it was found that when the sheet was heated to a temperature of 400° C. or higher, the heat treatment could be successfully carried out for any period of time up to 30 seconds or so, although there is no advantage to expending such energy after heating for a few seconds. When the 6111-T4 or T6 is heated at lower temperatures ≦400° C., the time at temperature is more critical. For heat treatment temperatures below 400° C., the heating time for maximum softness is $t(\text{seconds})=1.592\times10^{-6}\exp(8549/T)$, where T is in degrees K. However, softening benefits are obtained at these lower temperatures at times approximating the optimum times.

Similar heating schedules can be determined for other age-hardened alloys of the 2XXX, 6XXX and 7XXX series. Hemmability benefits are obtained by rapid heat treatment at 250° C. to 500° C., preferably 400° C. to 500° C., to dissolve the hardening precipitate and then quenching to room temperature to prevent immediate rehardening.

The subject retrogressive heat treatment provides additional benefits related to bending or folding operations on age-hardenable and age-hardened aluminum alloy sheets. In folding or bending a section of 6111-T4 or 6111-T6 sheet, such as in producing a flange as described above or a lesser bend of 45° to 60°, there is "springback" of the bent age-hardened alloy. In other words, while the forming dies initially bend a sheet 45°, e.g., the sheet springs back to a bend of 32°. The heat treatment of this invention, if practiced before such a bending or folding operation, markedly reduces such springback.

While the invention has been described in terms of a preferred embodiment thereof, it will be appreciated that other forms could readily be adapted by one skilled in the art. Accordingly, the scope of the invention is limited only by the following claims.

We claim:

1. A method of making a bend in a region of a sheet of age-hardened and age-hardenable aluminum alloy, comprising heating said sheet in the region to be bent to a temperature in the range of about 250° C. to 500° C. for a period of up to ten seconds and thereafter quenching the heated region to temporarily soften said region, and thereafter making said bend in the softened region.

2. A method of making a hem at an edge of a sheet of age-hardened and age-hardenable aluminum alloy, comprising heating said sheet in a region where a hem is to be formed to a temperature in the range of about 250° C. to 500° C. for a period of up to ten seconds and quenching the heated region to soften said region, and bending said sheet at said softened region to form a hem.

3. A method of making a hem at an edge of a sheet of age-hardened and age-hardenable aluminum alloy, comprising bending said sheet at an edge thereof to form a flange extending from said sheet, heating said sheet in the region comprising at least the bend of said flange and adjoining flange surface to a temperature in the range of about 250° C. to 500° C. for a period of up to ten seconds and quenching the heated region to soften said region, and thereafter folding said flange toward said sheet to form a hem before substantial age hardening of the heated region occurs.

* * * * *